US006146105A

United States Patent [19]

Williams

[11] Patent Number: 6,146,105

[45] Date of Patent: Nov. 14, 2000

[54] VENTURI PUMPING DEVICE

[76] Inventor: Luke Williams, 62B Canoelands Road, Glenorie, Australia, NSW 2157

[21] Appl. No.: 09/474,154

[22] Filed: Dec. 29, 1999

[51] Int. Cl.[7] ..... F04F 5/36

[52] U.S. Cl. ..... 417/195; 417/181; 417/151

[58] Field of Search ..... 417/195, 198, 417/151, 181

[56] References Cited

U.S. PATENT DOCUMENTS

| | | | |
|---|---|---|---|
| 1,643,025 | 9/1927 | Meggenhofen | 417/195 |
| 1,842,043 | 1/1932 | Modra | 417/195 |
| 2,044,088 | 6/1936 | Lord | 103/262 |
| 3,323,468 | 6/1967 | Thompson | 103/260 |
| 4,963,073 | 10/1990 | Tash et al. | 417/181 |
| 4,988,389 | 1/1991 | Adamache et al. | 166/302 |
| 5,797,421 | 8/1998 | Merrett | 137/236.1 |

FOREIGN PATENT DOCUMENTS

| | | |
|---|---|---|
| 128992 | 1/1997 | Australia . |
| 128993 | 1/1997 | Australia . |
| 129016 | 1/1997 | Australia . |
| 138821 | 11/1999 | Australia . |
| 714337 | 12/1999 | Australia . |

*Primary Examiner*—Charles G. Freay
*Assistant Examiner*—Robert Z. Evora
*Attorney, Agent, or Firm*—Richard M. Goldberg

[57] ABSTRACT

A venturi type pumping device including a body having a tubular through bore between a bore inlet end and a bore outlet end, a restriction in the bore acting to produce a reduction in pressure downstream from the restriction, a delivery device for the delivery from a delivery outlet of a pressurized stream of liquid substantially axially aligned with the bore and upstream from the bore inlet end, a bore extension member which terminates upstream from and encloses the delivery outlet, and a mounting device provided on the body for sealing engagement of the bore extension member to the body.

15 Claims, 1 Drawing Sheet

VENTURI PUMPING DEVICE

BACKGROUND OF THE INVENTION

The present invention relates to pumping devices in which a flow of a small quantity of a first fluid through a passageway will induce a flow of a second fluid through the passageway. Such devices have particular application where a vessel containing a liquid has to be emptied, and more particularly where the second fluid is a liquid with entrained solids.

Pumps of the above type are used in the swimming pool industry to empty pool water filters where the filtering medium is sand. It is to be understood, however, that there are many other uses for such pumps. In the swimming pool industry sand filters are commonly used to treat the pool water and when the filtration efficiency falls the sand is removed and replaced. Pumps of the type to which this invention relates are commonly used for the sand removal because the construction makes it possible to enter the pump into the filtering material housing through a small access hole.

The pump of the type with which this invention is concerned includes, more particularly, a tubular body adapted at its discharge end for connection to a discharge hose with a bore mounted venturi type fitting adjacent its inlet end. There is a high pressure delivery pipe adapted at one end for coupling to a pressurised water supply, such as a garden tap. At the other end the delivery pipe has a small orifice discharge port aligned with the axis of the bore fitting and spaced from the inlet end of the tubular body. Whilst ever the inlet end of the tubular body is submerged in a liquid reserve a flow of high pressure water through the venturi type fitting will result in a negative pressure in the tubular body sufficient to draw liquid from the liquid reserve and discharge is through the outlet end of the tubular body.

The efficiency of the device is dependent on many factors including the pressure and volume of the supply liquid and the venturi provided enhancement of the negative pressure resulting from the high pressure flow of the supplied liquid.

In known pumps the venturi fitting is commonly made of a plastics material which will be eroded away in a relatively short time where water with entrained filtration sand is being pumped. It would therefore be desirable to provide an easily mounted and removed wear resistant venturi fitting.

Another problem with known pumps is their inability to handle water of shallow depth. This is because the high pressure water supply jet needs to be below and spaced from the inlet end of the tubular body thereby placing the inlet end of the tubular body as a substantial distance above the floor of the container being drained. it would be desirable to provide a pump which overcomes this problem.

SUMMARY OF THE INVENTION

With this in mind, the present invention provides a venturi type pumping device including a body having a tubular through bore including a bore inlet end and bore outlet end, a restriction in the bore acting to produce the restriction in pressure downstream from the restriction, a delivery device for the delivery from a delivery outlet of a pressurised stream of liquid substantially axially aligned with the bore and upstream from the bore inlet end, a bore extension member which terminates upstream from and encloses the delivery outlet, and mounting means provided on the body for sealing engagement of the bore extension member to the body.

In one embodiment, the mounting means additionally provides a sealing engagement of the bore extension member to the delivery device.

Conveniently, the mounting means may comprise a membrane held within the bore extension member. The membrane may include a first aperture in which the body of the pumping device is sealingly mounted. A second aperture may also be provided in the membrane in which the delivery device is sealingly mounted.

The membrane may be formed from a resilient deformable material, such as rubber or like material.

In one embodiment, the body of the pumping device may comprise a tube portion in which is located the restriction. The restriction may be demountably held within the bore. Conveniently, the restriction may comprise a sleeve. The sleeve may be held within the bore by a sealing ring encircling the sleeve and acting to bear against an inner surface of the bore extension member.

One or more of the body, the delivery device and the tube extension member may be formed from erosion-resistant material, such as stainless steel.

BRIEF DESCRIPTION OF THE DRAWINGS

The invention will now be described with reference to the accompanying drawings which illustrate the venturi device type pumping device in an exemplary, non-limiting embodiment.

In the drawings.

DETAILED DESCRIPTION

Figure 1:
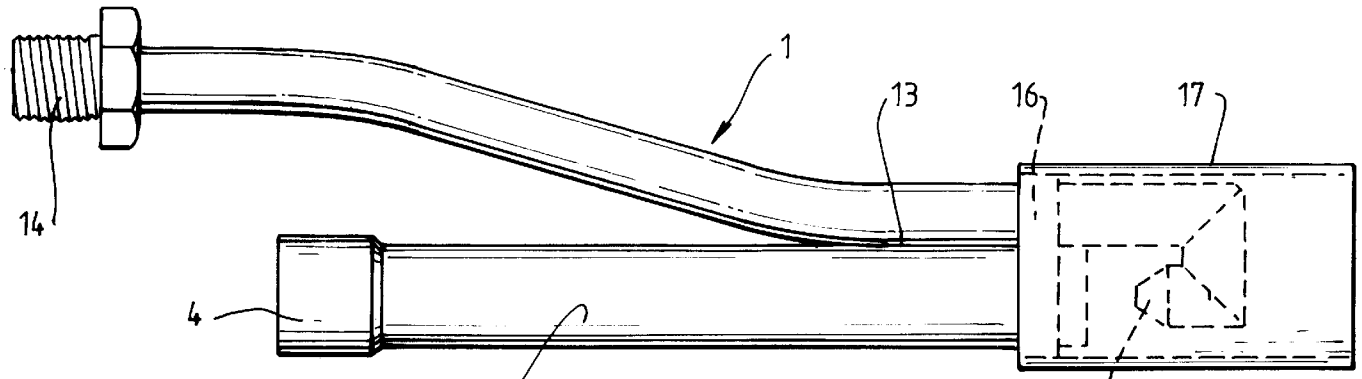
FIG. 1 is a side view of one embodiment of a venturi type pumping device according to the present invention.
Figure 2:
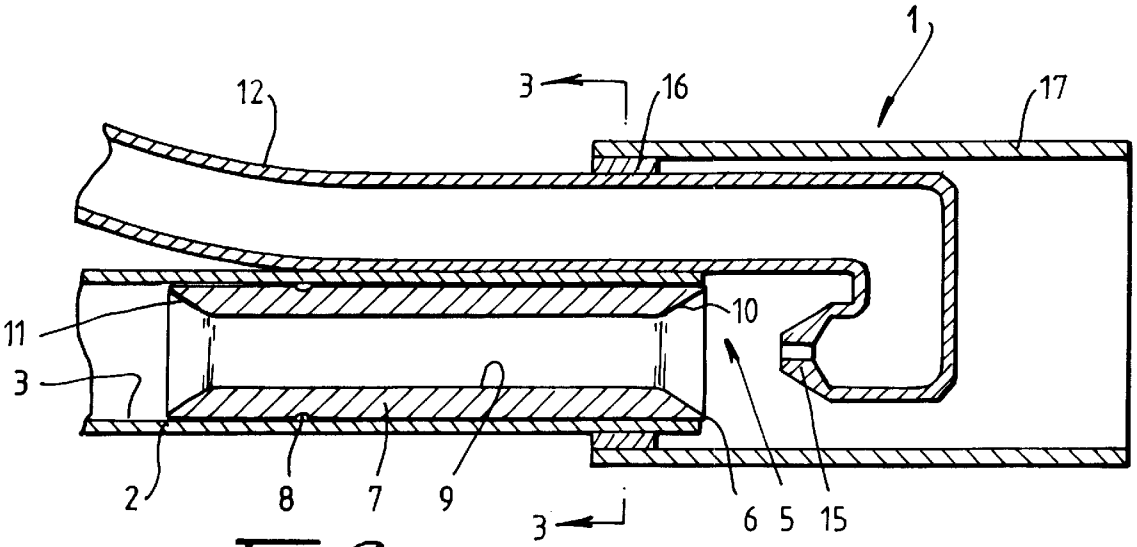
FIG. 2 is a cross-sectional side view of the venturi type pumping device of FIG. 1.
Figure 3:
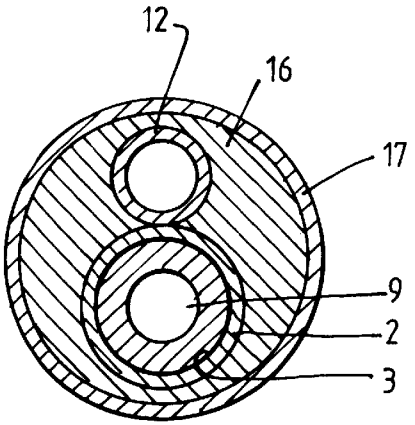
FIG. 3 is a cross-sectional end view of the venturi type pumping device of FIGS. 1 and 2.

Referring now to FIGS. 1 to 3, there is shown generally a pumping device 1 including a body including a length of tube portion 2 having a bore 3 adapted at an outlet end 4 for coupling to a discharge pipe or hose or the like. The tube portion 2 has an inlet end 5 with a low height bore restricting lip 6.

Within the bore 3 there is located a sleeve 7 or other restriction. The sleeve 7 abuts the lip 6 and has an encircling sealing ring 8. The bore 9 of the sleeve 7 is chamfered at the inlet end 10 of the sleeve and at the outlet end 11 of the sleeve. The reduction in cross-section of the bore 3 due to the inclusion of the sleeve 7 will result in a pressure drop at the outlet end 11 (downstream end) of the sleeve 7 when a high pressure stream of liquid passes through the sleeve bore 9.

A delivery, including a delivery pipe 12 and nozzle 15, delivers a pressurised stream of liquid to the body 2, 4.

The delivery pipe 12 is fixed to the tube portion 2 at a location 13 and has a coupling 14 at an inlet end to allow a supply line of high pressure liquid to be coupled to the pipe 12. The other end of the pipe 12 is shaped to direct liquid through a nozzle 15, or other delivery outlet, in a direction axially aligned with the bore 9 of the sleeve 7 from a location spaced upstream from the inlet end 5 of the tube portion 2.

A mount means 16 for a bore extension member 17 is provided. The mounting means 16 comprises a membrane held within the bore extension member 17 and acting to seal the outer surface of the tube portion 2 to the inner surface of the bore extension member 17. The membrane may be made of resilient, deformable material. The member 17 terminates upstream from the nozzle 15 which lies within the member 17. As can be best seen in FIG. 3, the membrane includes a first aperture in which the tube portion 2 is sealingly mounted, and a second aperture in which the pipe 12 of the delivery device is sealingly mounted.

In a use situation, the pump with delivery hose connected to 14 and a discharge hose connected to 4 would be lowered into a liquid reservoir with the member 17 closely adjacent the lowest point in the liquid reservoir. If desired the end of the member 17 can be notched allowing the end of the member 17 to rest on the surface of the liquid reservoir. High pressure liquid would then be delivered to the nozzle 15 which directs it into the sleeve 7. The flow through the sleeve 7 would result in a pressure drop at the sleeve downstream end and that pressure drop would draw liquid from the liquid reservoir into the tube 2 and into the hose coupled to 4.

Some advantages resulting from the pump construction just described are as follows. It provides a means whereby substantially all of the liquid in a vessel can be pumped. Moreover, there is provided a readily demountable venturi device which is resistant to erosion. The body, pump delivery device and tube extension member may pump preferably be made from stainless steel or other erosion-resistant material thereby minimising erosion and wear of the component parts.

The foregoing description is of a presently preferred embodiment of the invention. It is to be understood that changes can be made to the several components so far as shape and size without department from the inventive concepts herein disclosed.

What is claimed is:

1. A venturi type pumping device including:

a body having a tubular through bore between a bore inlet end and a bore outlet end, a restriction in the bore acting to produce a reduction in pressure downstream from the restriction;

a delivery device for the delivery from a delivery outlet of a pressurized stream of liquid substantially axially aligned with the bore and upstream from the bore inlet end;

a bore extension member which terminates upstream from and encloses the delivery outlet; and, a mounting device provided between the bore extension member and the body for sealing engagement of the bore extension member to the body.

2. A venturi type pumping device according to claim 1, wherein the mounting device additionally provides a sealing engagement of the bore extension member to the delivery device.

3. A venturi type pumping device according to claim 2, wherein the mounting device comprises a membrane held within said bore extension member.

4. A venturi type pumping device according to claim 1, wherein the mounting device comprises a membrane held within said bore extension member.

5. A venturi type pumping device according to claim 4, wherein the membrane includes a first aperture in which the body is sealingly mounted.

6. A venturi type pumping device according to claim 5, wherein the membrane includes a second aperture in which the delivery device is sealingly mounted.

7. A venturi type pumping device according to claim 6, wherein the membrane is formed from a resilient deformable material.

8. A venturi type pumping device according to claim 3, wherein the membrane is formed from a resilient deformable material.

9. A venturi type pumping device according to claim 5, wherein the membrane is formed from a resilient deformable material.

10. A venturi type pumping device according to claim 1, wherein the body comprises a tube portion including the restriction.

11. A venturi type pumping device according to claim 1, wherein the restriction is demountably held within the bore.

12. A venturi type pumping device according to claim 11, wherein the restriction comprises a sleeve.

13. A venturi type pumping device according to claim 12, wherein the sleeve is held within the bore by a sealing ring encircling the sleeve and acting to bear against an inner surface of the bore extension member.

14. A venturi type pumping device according to claim 1, wherein one or more of the body, the delivery device and the bore extension member are formed from erosion-resistant material.

15. A venturi type pumping device according to claim 14, wherein the erosion-resistant material comprises stainless steel.

* * * * *